US011135118B2

(12) United States Patent
Ivanov

(10) Patent No.: US 11,135,118 B2
(45) Date of Patent: Oct. 5, 2021

(54) PASSIVE RANGE OF MOTION DEVICE

(71) Applicant: Pavel Ivanov, Gilbert, AZ (US)

(72) Inventor: Pavel Ivanov, Gilbert, AZ (US)

( * ) Notice: Subject to any disclaimer, the term of this patent is extended or adjusted under 35 U.S.C. 154(b) by 232 days.

(21) Appl. No.: 16/410,987

(22) Filed: May 13, 2019

(65) Prior Publication Data

US 2019/0343708 A1 Nov. 14, 2019

Related U.S. Application Data

(60) Provisional application No. 62/670,532, filed on May 11, 2018.

(51) Int. Cl.
*A61H 1/02* (2006.01)

(52) U.S. Cl.
CPC ... *A61H 1/0255* (2013.01); *A61H 2201/1215* (2013.01); *A61H 2201/1676* (2013.01)

(58) Field of Classification Search
CPC ..... A61H 1/0255; A61H 2201/1215; A61H 2201/1676; A61H 2201/5069; A61H 2201/1642; A61H 2201/5007; A61H 2201/0192; A61H 2205/062; A61H 2201/1678; A61H 1/0244; A61H 1/0281; A61H 2201/5097; A61H 2201/1645; A61H 2201/5064; A61H 2201/5043; A61H 2205/088; A61H 2201/1638; A61H 2201/5058; A61H 2201/149; A61H 1/00; A61H 1/02–0288
See application file for complete search history.

(56) References Cited

U.S. PATENT DOCUMENTS 4,509,509 A * 4/1985 Bouvet ..... A61H 1/0255 601/15
4,834,073 A 5/1989 Bledsoe et al.
4,986,261 A 1/1991 Iams et al.
(Continued)

FOREIGN PATENT DOCUMENTS

KR 1020060118365 A 11/2006
KR 1020090099497 A 9/2009
WO 9415571 A1 7/1994

OTHER PUBLICATIONS

Hip Continuous Passive Motion Device/Knee Fisiotek 3000 G Rimec, www.medicalexpo.com/prod/rimec/product-69852-569161, Jan. 23, 2018, Medical Expo.

*Primary Examiner* — Andrew S Lo
(74) *Attorney, Agent, or Firm* — Schmeiser, Olsen & Watts LLP

(57) ABSTRACT

A passive range of motion device is disclosed. The passive range of motion device is configured to deliver passive rotational motion to a joint, such as a hip joint. Although the use of passive range of motion devices to deliver postoperative physical therapy to hip or shoulder joints is widespread, these devices deliver motion therapy in only one plane. The hip and shoulder joints, however, allowing motion of the leg or arm in multiple planes. A device for delivering passive range of motion therapy in multiple planes to a joint, such as a hip joint or a shoulder joint, is described. The device may have a processing unit for storing user information and device status information. The device may be controlled by a controller attached to the device, or remotely, such as by a remote desktop computer or a mobile computing device.

16 Claims, 8 Drawing Sheets

(56) References Cited

U.S. PATENT DOCUMENTS 5,179,939 A * 1/1993 Donovan ..... A61H 1/0281 482/4
5,258,019 A 11/1993 Riddle et al.
5,300,090 A 4/1994 Primic
5,333,604 A * 8/1994 Green ..... A61H 1/0255 601/33
5,618,262 A * 4/1997 Rene ..... A61H 15/0078 601/100
5,913,759 A 6/1999 Bostrom
6,416,448 B1 * 7/2002 Hassler ..... A61H 1/024 482/113
9,901,505 B2 * 2/2018 Bombard ..... A61H 9/0078
10,682,543 B1 * 6/2020 Alvarez ..... A61H 1/00
10,765,901 B2 * 9/2020 Radcliffe ..... A61H 1/0244
2004/0003468 A1 * 1/2004 Mitsuishi ..... A61H 1/0255 5/624
2005/0143226 A1 6/2005 Heidecke
2005/0273022 A1 * 12/2005 Diaz ..... A61H 1/0259 601/5
2006/0211957 A1 * 9/2006 Beny ..... A61H 1/0259 601/5
2008/0032877 A1 2/2008 Denisco
2009/0082704 A1 * 3/2009 Nov ..... A61H 1/005 601/27
2009/0275868 A1 * 11/2009 Steingart ..... A61H 1/024 601/34
2011/0275500 A1 11/2011 Hur
2011/0300994 A1 * 12/2011 Verkaaik ..... A61H 1/0285 482/51
2012/0232438 A1 * 9/2012 Cataldi ..... A63B 21/4045 601/5
2013/0204168 A1 * 8/2013 Bombard ..... A61H 1/0244 601/5
2014/0081181 A1 * 3/2014 Branch ..... A61B 5/4585 600/595
2014/0094721 A1 * 4/2014 Diallo ..... A63B 21/0058 601/5
2014/0148736 A1 * 5/2014 Hoffman ..... A61H 1/0259 601/5
2014/0180178 A1 * 6/2014 Jocofsky ..... A61H 1/0237 601/5
2014/0329652 A1 11/2014 Oh
2015/0359697 A1 * 12/2015 Celik ..... A61H 1/0274 601/33
2015/0374574 A1 * 12/2015 Cataldi ..... A63B 21/00178 601/5
2016/0271443 A1 9/2016 Malizia
2018/0146891 A1 * 5/2018 Branch ..... A61B 5/1121
2018/0177662 A1 * 6/2018 Bombard ..... A61H 1/006
2019/0254854 A1 * 8/2019 Lee ..... A61H 1/0262
2020/0129365 A1 * 4/2020 Park ..... A61H 1/0274

* cited by examiner

PASSIVE RANGE OF MOTION DEVICE

CROSS REFERENCE TO RELATED APPLICATION[S]

This application claims priority to U.S. Provisional Patent Application to Pavel Ivanov entitled "PASSIVE RANGE OF MOTION DEVICE," Ser. No. 62/670,532, filed May 11, 2018, the disclosures of which are hereby incorporated entirely herein by reference.

BACKGROUND OF THE INVENTION

Technical Field

The present invention relates generally to passive range of motion devices; specifically, to devices providing passive range of motion therapy to a joint.

State of the Art

Surgical procedures on the hip joint are commonly performed in the United States. For example, total hip replacements during the decade between 2000 and 2010 rose from 142 to 257 per 100,000 persons in the general population. Additionally, the use of hip arthroscopy is becoming more popular among orthopedic surgeons, with a quoted incidence in orthopedic surgical procedures of 4 cases per 10,000 orthopedic procedures.

It is well-established that movement following surgery on the hip joint is beneficial. Physical therapy utilizing passive range of motion joint therapy decreases pain, reduces swelling through stimulation of venous and lymphatic drainage, preserves and restores normal range of joint motion, speeds and enhances healing, and strengthens surrounding muscles, ligaments, and connective tissues. Early range of motion ("ROM") therapy is commonly used to prevent formation of intra-articular adhesions.

Although machines are available to perform passive ROM ("PROM") therapy on postoperative patients, the motion provided by these machines is generally limited to a single plane. PROM therapy to a hip joint is delivered in the sagittal plane. For example, currently available devices move the patient's leg up-and-down off the bed. Because the hip joint of a patient reclining in a bed is in a position approximately neutral with respect to flexion-extension, use of currently available PROM devices typically results in the hip joint being moved between a neutral position and a partially flexed position. This fails to adduct or abduct the hip joint, because the passive motion is limited to a single two-dimensional plane. There is no multi-planar joint movement. It is likely that passive motion in three dimensions greatly increases the benefits of early motion after hip joint surgery, over simple two-dimensional motion in the sagittal plane alone.

Accordingly, a passive PROM device that generates multi-planar motion of the hip joint is needed for optimal post-operative rehabilitation therapy of hip surgery patients.

SUMMARY OF THE INVENTION

The present invention relates generally to passive range of motion devices; specifically, to devices providing passive range of motion therapy to a hip joint.

Disclosed is a passive range of motion device comprising a base; a pivoting member rotationally coupled to the base; a limb support having a first end and a second end, the first end of the limb support hingedly coupled to the pivoting member; an offset member coupled to the second end of the limb support, wherein rotation of the offset member causes the second end to move in a circular motion; and a drive motor coupled to the offset member.

In some embodiments, activation of the drive motor causes the second end of the limb support to move along a circular path. In some embodiments, the passive range of motion device comprises one or more securing straps coupled to the limb support. In some embodiments, the passive range of motion device comprises an offset adjustor. In some embodiments, the passive range of motion device comprises a height adjustor. In some embodiments, the passive range of motion device comprises a rotary-to-linear motion device.

In some embodiments, the passive range of motion device may be controlled by controller that may be coupled to the device or may be a remote control, such as a handheld remote-control device, or a computing device, including any stationary or mobile computing device, such as a smartphone, a tablet, or the like. The controller is communicatively and operatively coupled to the device, whether wired or by a wireless signal, such as Bluetooth, or an internet connection, to remotely cause changes in the operation of an element, or combination of elements, of the device.

In some embodiments, the passive range of motion device comprises various sensors coupled to elements of the device for sensing position, orientation, motion, angle, speed, and/or frequency of motions, and the like, of various elements of the device. Further, some embodiments may comprise a processing unit communicatively coupled to the various sensors and to the controller, the processing unit further comprising a processor and a memory. The processor may be programmed or pre-programmed to control the various elements of the device in response to signals from any of the various sensors as well as input by a user to the controller.

Some embodiments may comprise a processing unit communicatively coupled to the various sensors and to the controller, the processing unit further comprising a processor and a memory. The processor may be programmed or pre-programmed to receive signals from the various sensors, the signals containing information about the various elements of the device. The processor may process these signals and store and/or retrieve such information to or from the memory. The processor may also send such information to the controller for display on the controller. The processor may further be communicatively coupled to the drive motors and/or actuators of the various elements of the device, such that the drive motors and/or actuators may be controlled by the processor, in response to user input to the controller The processing unit may be configured to store user information on the memory and information regarding the status of the at least one controllable element of the device, as that information is received by the processing unit from a sensor coupled to the at least one controllable element. The information may be stored on the memory 14 in association with the user profile of the user that was using the device when the information was received by the processing unit. Such information may be stored to create a usage record for the user. The user may make adjustments to the status of the at least one controllable element by input to the controller. For example, without limitation, a user may use the device at one location and a physical therapist overseeing treatment of the user may access the usage record of a user remotely and make adjustments to the device to change the status of the at least one controllable element.

In some embodiments, user information and user records, including the status of at least one controllable element of the device may be stored remotely on, and/or retrieved from, a controller, or a server that is communicatively coupled to and accessible by the controller.

A method of using a passive range of motion device is also disclosed.

The foregoing and other features and advantages of the present invention will be apparent to those of ordinary skill in the art from the following more particular description of the invention and its embodiments, and as illustrated in the accompanying drawing figures.

DETAILED DESCRIPTION OF EMBODIMENTS OF THE INVENTION

Figure 1A:
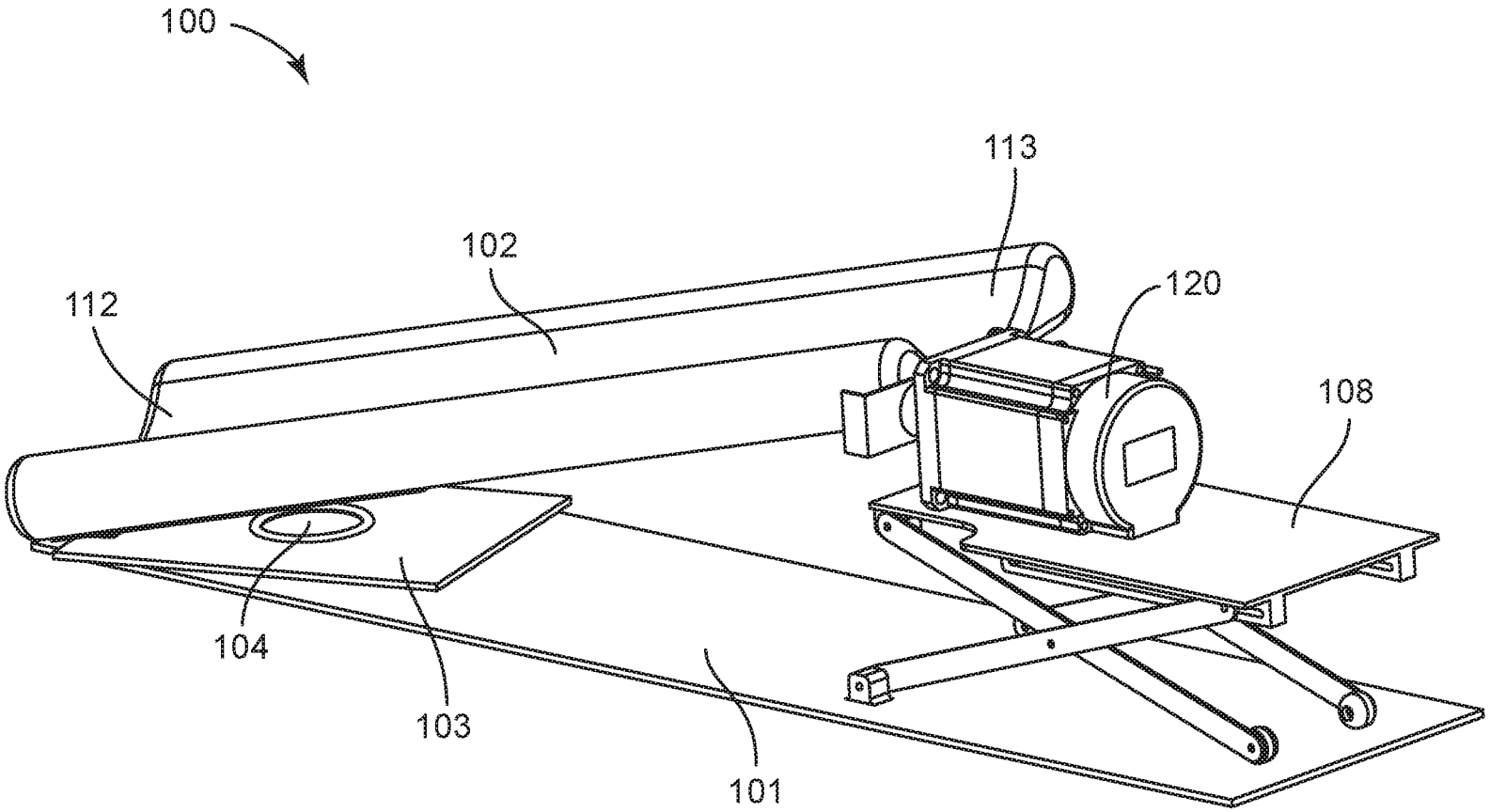
FIGS. 1A-B are perspective views of a passive range of motion device, in accordance with an embodiment.

As discussed above, this disclosure relates generally to passive range of motion devices; specifically, to devices providing passive range of motion therapy to a joint, such as a hip joint.

Conventional passive ROM machines used for rehabilitation therapy after hip surgery are generally limited to providing motion in the sagittal plane.

The passive range of motion device of the present invention may be used for passive rotation of the hip joint, the shoulder joint, or other joints, depending upon the characteristics of the joint targeted for PROM therapy and the embodiment of the invention. Unless otherwise stated, however, it should be assumed that anatomic relational terms are used as they apply to the hip joint. For example, flexion, extension, adduction, abduction, and rotation mean flexion, extension, adduction, abduction, and/or rotation of the hip joint.

For the purposes of this disclosure, anatomic relational terms describing motion of a joint have the commonly accepted meanings used in the medical literature. Moreover, those of skill in the medical, physical therapy, and medical device arts will be familiar with such terms. Accordingly, "Medial" means the side or aspect of an anatomic structure nearest the midline of a human body. "Lateral" means the side or aspect of an anatomic structure furthest from the midline of a human body and is the opposite aspect of a structure as its medial aspect. "Proximal" means closer to the head than an additional region of the structure being discussed. In the lower extremity, for example, the hip joint is proximal to the knee joint. "Distal" means further from the heart than other regions of the structure being discussed; i.e., the foot is distal to the knee joint. "Dorsal" means back or behind; i.e., the hamstrings are on the dorsal aspect of the leg. "Ventral" means front; i.e., the front of the thigh is the ventral aspect of the thigh. The "sagittal plane" means the imaginary anatomic plane running through the center of the body which divides the human body, or a structure of the body, into a left side and a right side.

The disclosed PROM device is configured to deliver passive motion to a joint, such as a hip joint. A user of the disclosed PROM device positions an extremity, such as a patient's leg, onto a limb support. Embodiments of the PROM device then moves the distal end of the limb support in a circular motion, wherein the patient's joint disposed near a proximal end of the limb support is passively rotated. A drive motor operationally coupled to the limb support at or near the distal end causes the circular motion through an offset member such as crank arm, for example.

A length of the offset member is adjustable, in some embodiments, wherein a diameter of the circular motion may be chosen and set by the user, according to therapeutic goals, characteristics of the joint receiving PROM therapy, and similar anatomic and clinical considerations. The height of the distal end above the base is also adjustable, in some embodiments, to allow for both adequate clearance off the base for the circular motion of the distal end and to adjust a maximum degree of flexion of the hip joint, for example, during a cycle of the circular motion.

Figure 1B:
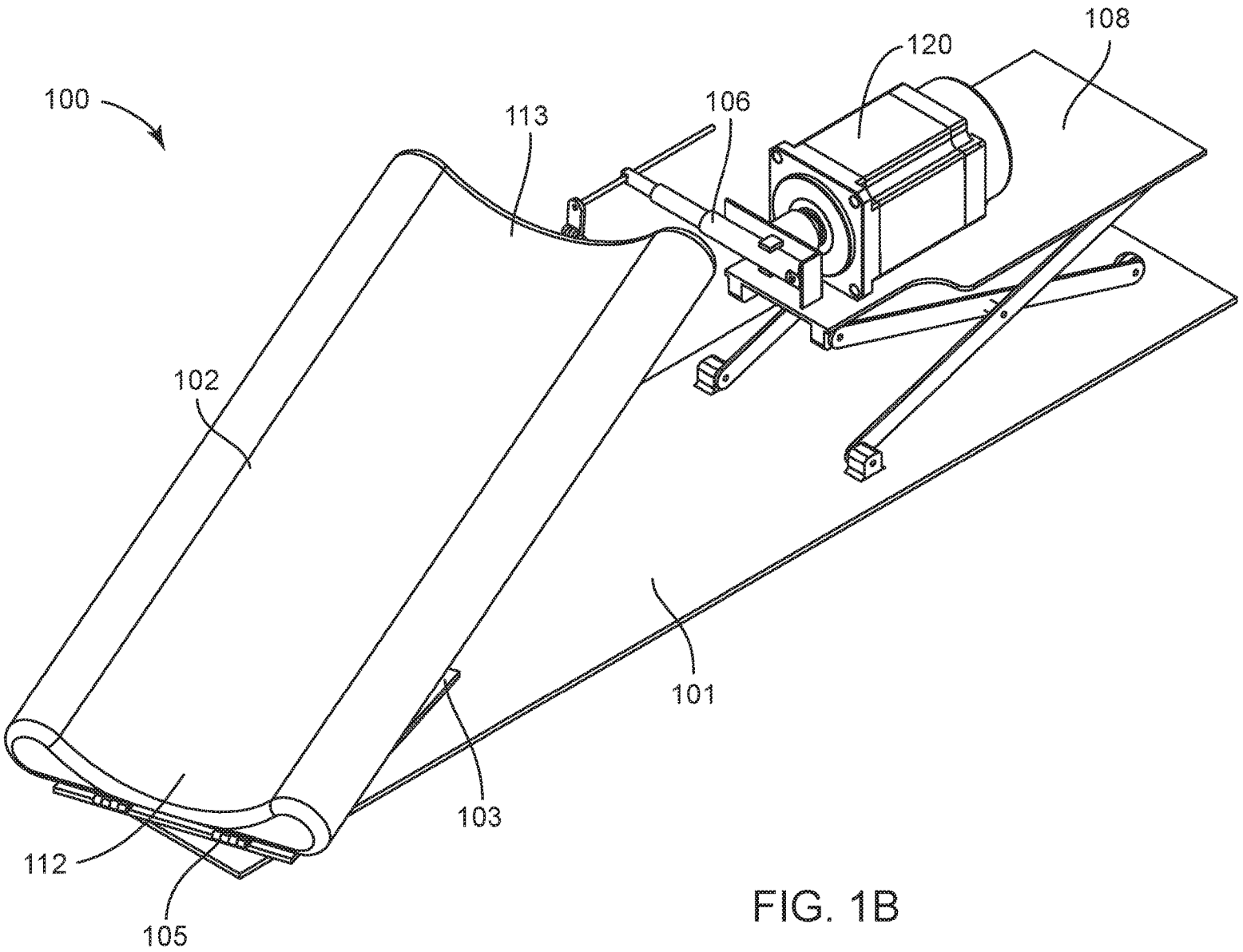

FIGS. 1*a-b* are perspective views of a passive range of motion device. FIG. 1*a* and FIG. 1*b* show a passive range of motion (PROM) device 100. In some embodiments, PROM device 100 has a pivoting member 103 rotatably secured to base 101 at a joint 104, such as, but not limited to a swivel joint. Pivoting member 103, in turn is hingedly coupled to a limb support 102. Base 101, in some embodiments, is a structure formed to rest on a flat surface, such as a mattress of a hospital or other bed. This is not meant to be limiting, however. In some embodiments, base 101 is configured to mount on a hospital or other bed, bed frame, or bed frame attachment, or even a floor surface, a mat, or any other surface that allows proper operation of the PROM device 100. During operation of PROM device 100, base 101 remains essentially stationary while limb support 102, coupled to a patient's leg, is in motion. Consequently, base 101 may take many forms, provided base 101 rests on, is clamped to, or otherwise stabilized by a substantially non-moving surface or body.

Pivoting member 103 is coupled between base 101 and limb support 102 at joint 104. Pivoting member 103 is hingedly connected to a first end 112 of limb support 102 by a joint 105, such as, but not limited to a hinge joint. Pivoting member 103 and joint 105 are configured to moveably couple limb support 102 to base 101 such that limb support 102 moves respective to base 101: 1) up-and-down in an arcuate motion at joint 105; and 2) 360-degree rotational motion at joint 104 about an axis of joint 104 extending perpendicular to base 101. As shown in FIGS. 1*a-b*, motion at joint 105 is within a first plane substantially orthogonal to motion within a second plane at joint 104. Motion of limb support 102, therefore, simultaneously has a first component in the first plane and a second component in the second plane, with respect to base 101. It is contemplated that joints 104 and 105 may be a unitary joint allowing both the arcuate motion and the rotational motion described above, such as a ball joint, for example.

In some embodiments, pivoting member 103 is a structure with a substantially planar bottom surface that rotatably slides across an opposing substantially planar top surface of base 101, such as the embodiment shown by FIGS. 1*a-b*, and in some other embodiments. In some embodiments, pivoting member 103 is separated from direct contact with base 101 by joint 104. It should be understood that many configurations of joint 104 may be used to couple pivoting member 103 to base 101 within the scope of this disclosure, allowing rotational movement of pivoting member 103 with respect to base 101.

Joint 105 may couple limb support 102 to pivoting member 103 along a fixed axis, wherein components of the joint 105 may rotate around the fixed axis, and the joint 105 may be a hinge, such as, but not limited to a butt hinge, a flush hinge, a piano hinge, a mortise hinge, a barrel hinge, or other types of hinge joints known in the mechanical arts. The particular type of hinge used to form joint 105 depends upon the configuration of pivoting member 103 and limb support 102 present in the particular embodiment of the invention.

Elements of PROM device 100 that generate and are configured for adjusting the rotational motion of limb support 102 are operatively coupled to a second end 113, in some embodiments. As also shown by FIGS. 1*a-b*, second end 113 of limb support 102 is located opposite first end 112. PROM device 100 generates motion of the leg, or other extremity of a user, in response to operation of the PROM device 100 with the leg, or other extremity of the user, coupled to the PROM device 100. For example, PROM device 100 moves the leg up and down (hip flexion/extension) and left and right (adduction/abduction). During operation of PROM device 100, in some embodiments, the motion of second end 113 follows a circular path. The radius of the circular path is adjustable, in some embodiments. Also, a median height above the base and thereby the median height above the bed, or other surface upon which the patient is positioned, is also adjustable, in some embodiments. For example, PROM device 100 may be used to provide PROM therapy to a hip joint, the median height adjustment and adjustment of the length of the offset member 106 determines the degree of hip flexion and the radius of the circular path traveled by second end 113 during operation, thus determining the degree of hip flexion and the amounts of abduction and adduction of the hip joint during PROM therapy with PROM device 100.

Figure 2:
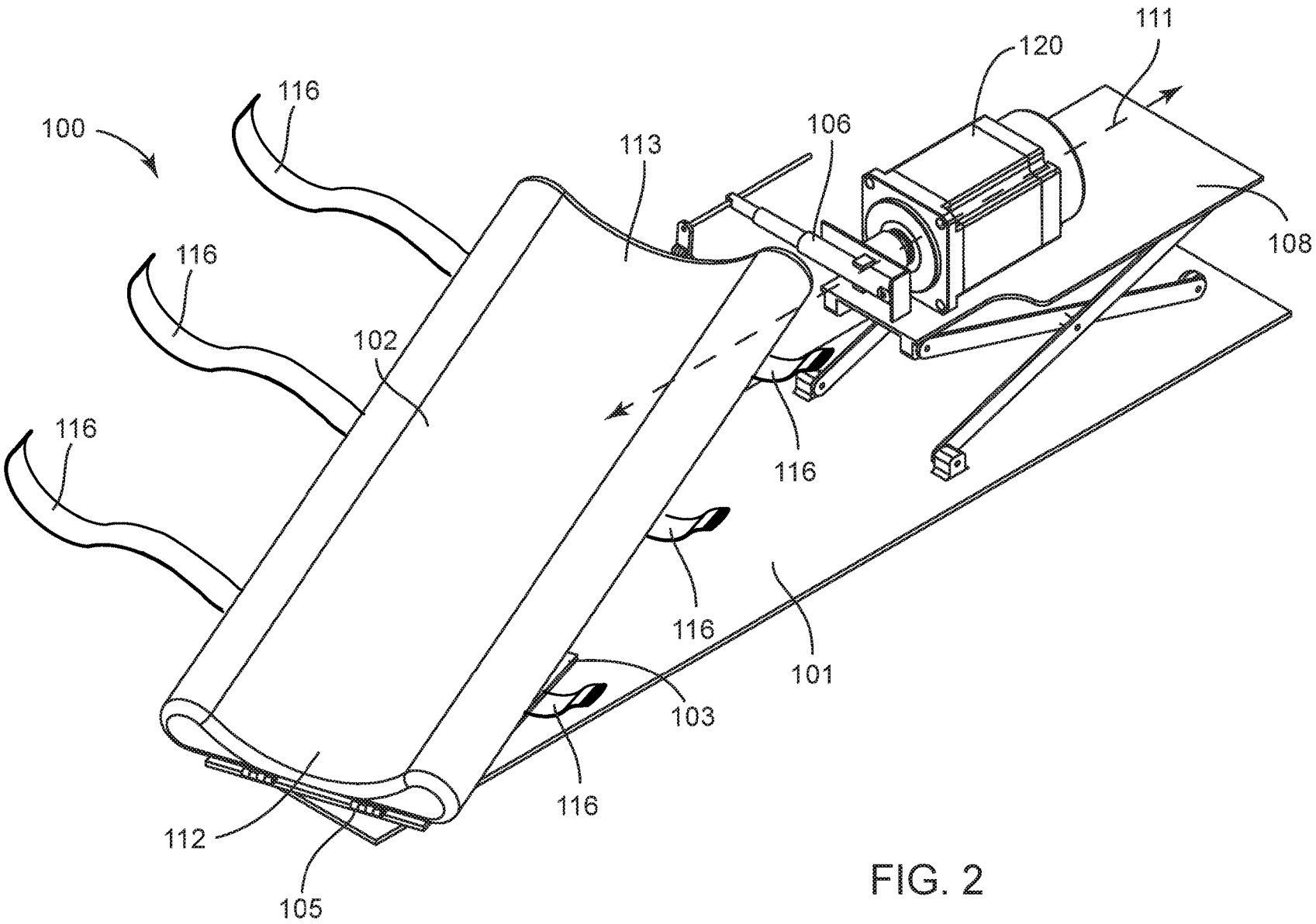
FIG. 2 a perspective view of a passive range of motion device, in accordance with an alternative embodiment.
Figure 3:
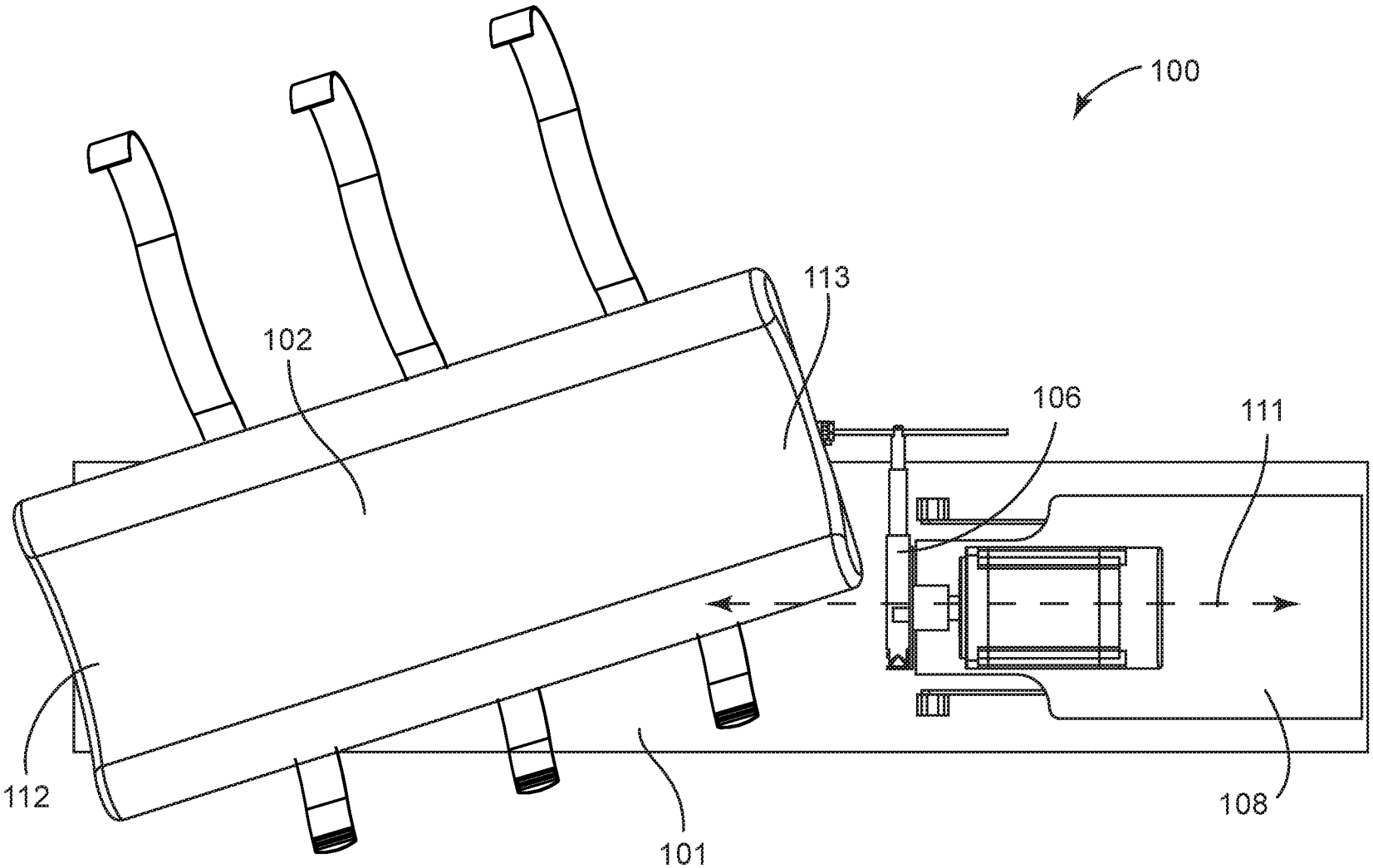
FIG. 3 is a top perspective view of a passive range of motion device, accordance with the embodiment of FIG. 2.

FIG. 2 is a top perspective view of a passive range of motion device. FIG. 3 is a top view of a passive range of motion device. In the example embodiment of device 100 shown by FIG. 2 and FIG. 3, and in some other embodiments, an offset member 106 is rotationally coupled to second end 113. Offset member 106 may operate to translate rotational motion around a central axis 111 into circular motion of second end 113. Offset member 106 determines a length of a radius of a circle traveled by second end 113. Various structures and mechanical mechanisms may be used to construct offset member 106, provided said structures and mechanisms translate rotation around central axis 111 to a circular motion of second end 113.

A height adjustor 108 operates to set and adjust a median height of second end 113 during operation of PROM device 100. Height adjustor 108 is coupled to base 101 and rotationally coupled, in some embodiments, to offset member 106, wherein offset member may rotate with respect to height adjustor 108. In some embodiments, height adjustor 108 is coupled to base 101. Height adjustor 108 is configured to determine and adjust a median height of second end 113 above base 100, in some embodiments. In some embodiments with a shorter base 101 wherein base 101 does not extend beneath second end 113, height adjustor 108 is configured to determine and adjust a median height of second end above the bed or other surface whereupon the patient is positioned.

The median height of second end 113 above base 101, or the surface of a structure, such as a bed, supporting the patient, determines the minimum amount of hip flexion. Increasing the median height of second end 113 via height adjustor 108 changes the overall position of the patient's extremity during the PROM therapy. For example, increasing the median height causes the PROM therapy to be delivered at a higher degree of hip (or shoulder) flexion and decreasing the median height delivers therapy as a lesser degree of flexion. Various mechanical structures which allow for height adjustment, including but not limited to the scissors mechanism shown by FIG. 1A, may be used to form height adjustor 108.

A drive motor 120 is operatively coupled to offset member 106, offset adjustor 107, height adjustor 108, or any combination of offset member 106, offset adjustor 107, and height adjustor 108, in some embodiments. The drive motor 120 causes rotation of offset member 106 around central axis 111, either directly or through a mechanical or electromechanical linkage. In some embodiments, multiple drive motors 120 may be employed, wherein a drive motor 120 couples to each the offset member 106, offset adjustor 107 and height adjustor 108, respectively, wherein the motors 120 operate independently to adjust and operate PROM device 100.

Limb support 102 is configured to removably couple to the patient's leg, arm or other body part coupled to and distal to the joint receiving PROM therapy. Limb support 102 may be formed as an elongated structure with a top surface and a bottom surface. The top surface may bear attachment members 116, such as straps, for example, to removably secure device 100 to a user's extremity during PROM therapy. FIG. 2 shows a plurality of attachment members 116 coupled to limb support 102. Accordingly, limb support 102 may be molded to generally conform with the dorsal surface of a patient's leg. In some embodiments, limb support 102 may include padding members to cushion soft tissues of the leg or other extremity (not shown). In some embodiments, a pad member is coupled to the top surface of limb support 102 wherein the dorsal surface of the knee rests on the pad member and the size of the pad member determines the degree of flexion of the knee. In some embodiments, the pad member is interchangeable with a plurality of pad members of assorted dimensions to accommodate use of PROM device 100 by users of different leg and knee sizes.

Figure 4:
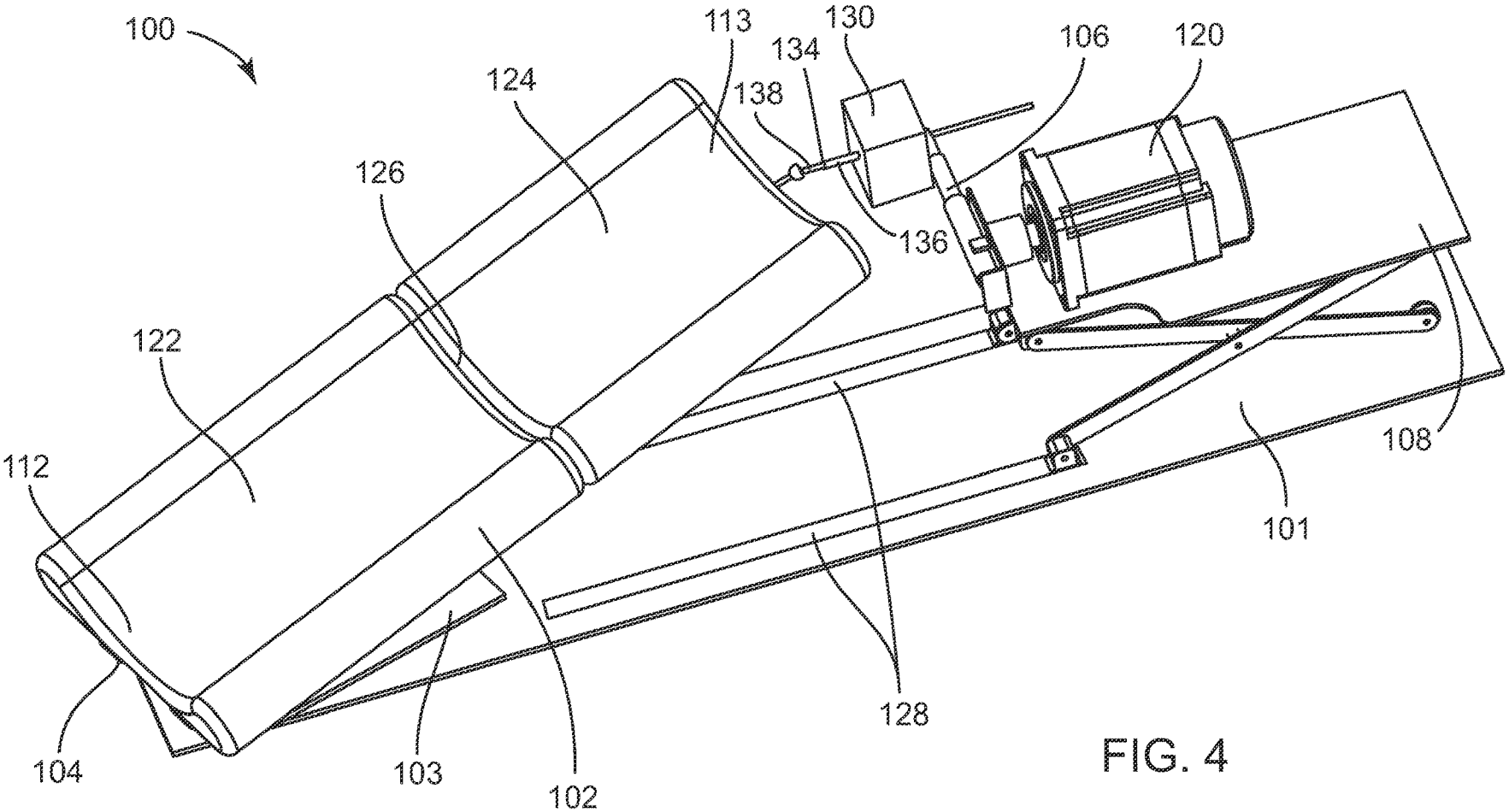
FIG. 4 is a perspective view of a passive range of motion device, in accordance with yet another embodiment.

Some applications of hip PROM therapy require combining knee flexion with hip flexion. Knee flexion releases tension on hip extensor muscles, including the biceps femoris, semimembranosis, and semitendinosis. Releasing tension on hip extensors allows for increased hip flexion. In some patients, simultaneous knee flexion is required to achieve hip flexion greater than ninety (90) degrees. Accordingly, as shown in FIG. 4, limb support 102 comprises a proximal first section 122 hingedly coupled to a distal second section 124 in some embodiments of device 100, by hinge 126. Such embodiments of device 100 combine passive movement of a user's knee through flexion and extension simultaneously with the hip motion as described herein above. Such embodiments further comprise a mechanism for allowing height adjustor 108 to slide toward joint 104 as the hinge 126 is raised, and to slide away from joint 104 as the hinge 126 is lowered again. The first and second sections 122 and 124 of limb support 102 are thereby rotated about the hinge 126, to effect flexion and extension of the user's knee, in response to sliding of the height adjustor 108 toward and away from joint 104. For example, height adjustor 108 may be mounted to a linear actuator, such as a rack and pinion, or screw actuator, or the like, that is activated by a drive motor. In some embodiments, as shown in FIG. 4, height adjustor 108 may slide along tracks 128 mounted to base 101, thereby raising or lowering hinge 126.

In some embodiments, the first and second sections 122 and 124 of limb support 102 are fixed at a set knee flexion angle. In some embodiments, the knee flexion angle is dynamic through a range of knee flexion angles as second end 113 of limb support 102 traces a circular path around axis 111.

In some embodiments, a passive range of motion device 100 may further comprise a rotary-to-linear motion device 130 operatively coupled between offset member 106 and second end 113 of limb support 102. The rotary-to-linear motion device 130 may comprise a mechanism 132 for converting rotary motion to linear oscillating motion, and an oscillating arm 134 extending therefrom. The oscillating arm 134 may be comprised of two components 136 and 138 that are slidingly coupled together, such that the overall length of the oscillating arm 134 may be varied as the two components 136 and 138 slide relative to each other. The oscillating arm 134 swings back and forth, in pendular motion, in response to rotary motion input, such as by a motor drive, by operation of the rotary-to-linear device 130. In some embodiments, rotary motion input to the rotary-to-linear device 130 is by a separate drive motor 120 mounted to the device 130. The oscillating arm 134, being coupled to the second end 113 of limb support 102, causes the second end 113 to oscillate in concert with the oscillating arm 134. Thereby, the second end 113 of limb support may oscillate in a linear fashion up and down, side to side, or diagonally, at any angle corresponding to the angle of rotation of the offset member 106. The sliding mechanism of the two-part oscillating arm 134, as described above, allows for the oscillating arm 134 to extend and retract, as the arm 134 pendulates in an arc about the rotary-to-linear device 130, and the limb support 102 pendulates in an opposing arc about the joint 104.

Figure 5:
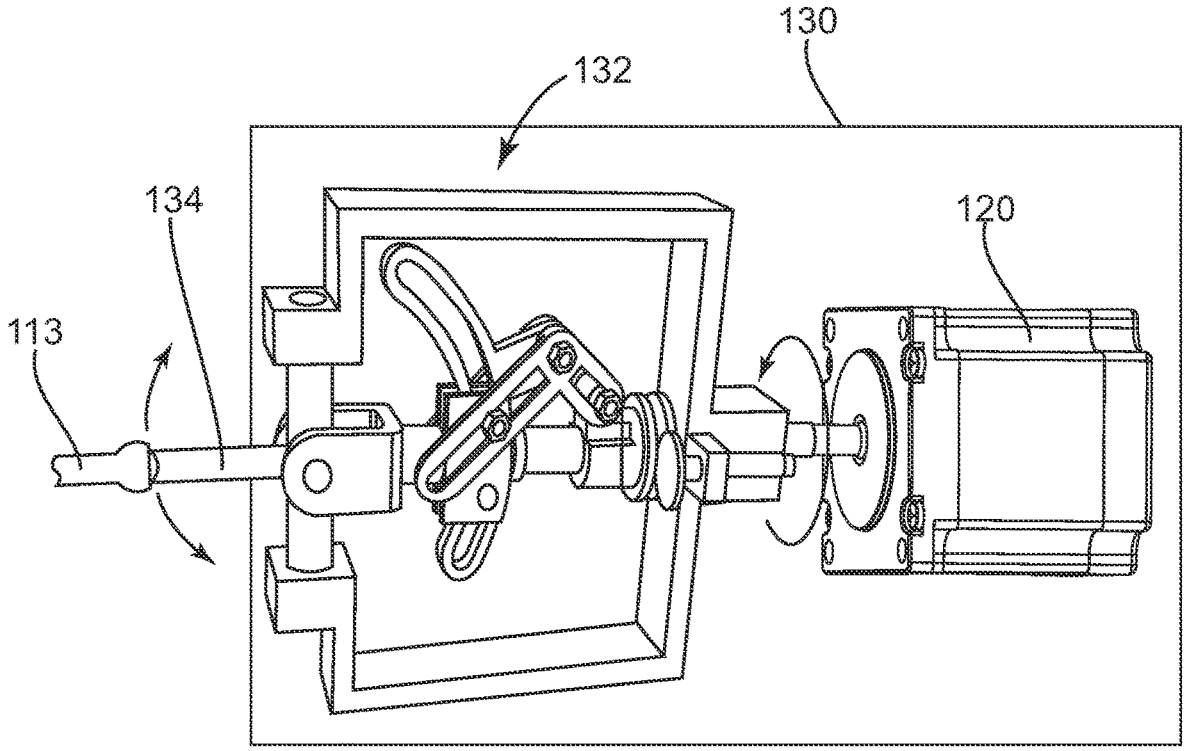
FIG. 5 is a perspective view of a rotary-to-linear motion device of a passive range of motion device, in accordance with an embodiment.

In some embodiments, the rotary-to-linear motion device 130 may be an adjustable rotary-to-linear motion device 130, as shown in FIG. 5, wherein the magnitude of the oscillating motion of the oscillating arm 134, and, therefore, the second end 113 of limb support 102, is adjustable. For example, the adjustable rotary-to-linear motion device may be adjusted such that the second end 113 of limb support 102 oscillates more than one foot in either direction, or less than one foot in either direction. Furthermore, the adjustable rotary-to-linear motion device 130 may be adjusted such that the second end 113 of limb support 102 does not oscillate at all when the magnitude of oscillation is adjusted to zero. The maximum magnitude of oscillation of the oscillating arm 134 is limited by the extent of adjustment of the adjustable rotary-to-linear device 130, and by the length of the oscillating arm 134. Accordingly, the mechanism 132 may comprise a rotary oblique disk mechanism, an adjustable oblique disk mechanism, an adjustable rocker mechanism, or any other suitable rotary-to-linear motion mechanism known now or in the future, whether adjustable or not adjustable. An example of an adjustable rocker mechanism is the mechanism 132 shown in FIG. 5. The rotary-to-linear motion device 130 may be any suitable rotary-to-linear motion device known to a person of ordinary skill in the art and not limited to that shown in FIG. 5.

In operation, an adjustable rotary-to-linear motion device 130 may be adjusted such that the magnitude of the oscillating motion of the oscillating arm 134, and, therefore, the second end 113 of limb support 102, is greater than zero. Further, the offset adjuster 107 may be rotated to an angle corresponding to pendular motion of the oscillating arm in a horizontal plane, for adduction and abduction of a user's hip joint, for example. Alternatively, the offset adjuster 107 may be rotated to an angle corresponding to pendular motion of the oscillating arm in a vertical plane, for flexion and extension of the user's hip joint. Similarly, the offset adjuster 107 may be rotated to any angle corresponding to pendular motion of the oscillating arm in any diagonal plane between the horizontal plane and the vertical plane, to achieve various combinations of adduction, abduction, flexion, and extension of the user's hip joint. The degree of adduction, abduction, flexion, and/or extension of the user's hip joint may be controlled by adjustment of the adjustable rotary-to-linear motion device 130. Similar corresponding adjustments may be made to control motions of other embodiments of a passive range of motion device configured for use with a user's shoulder joint, or other joint, rather than a hip joint.

In some embodiments, the offset member 106, and the drive motor 120 coupled thereto, may be mounted to a framework such that the offset member 106 and the drive motor 120 may be rotated 90 degrees to allow for rotation of the offset member 106 in a circular path in a horizontal plane in response to operation of the drive motor 120. This motion can only be performed when height adjustor 108 has been slid along tracks 128 such that hinge 126 is elevated above the base 101, thereby allowing the second end 113 of limb support 102 to move in a horizontal circular path. Accordingly, rotation of the offset member 106 and the drive motor 120 is not limited to a 90-degree rotation. Offset member 106 and drive motor 120 may be rotated to an angle that is less than 90 degrees or more than 90 degrees, such that the resulting circular path of the second end 113 of limb support 102 is other than horizontal.

An advantage of some embodiments of the present invention is that elements of the device may be used in combination to achieve compound motions. For example, one desirable compound motion is achieved by using height adjustor 108 to raise the second end 113 of limb support 102 to a height equal to the length of the first section 122 and sliding height adjustor 108 along tracks 128 to raise hinge 126 until the first section 122 is vertical. In this position, when a user's leg is strapped to the limb support 102, the upper leg, or thigh portion, of the user is vertical and the lower leg, or shin portion, of the user is horizontal. Then, the rotary-to-linear motion device 130 may be used to pendulate the second end 113 of limb support 102 in a side-to-side arcuate motion about the hinge 126. Simultaneously, the height adjustor 108 may be slid forward and backward along tracks 128 in a synchronous motion with the motion of the rotary-to-linear motion device 130 to achieve motion of the second end 113 of limb support 102 along a horizontal circular path.

In some embodiments, device 100 may be controlled by controller that may be coupled to the device 100 or may be a remote control (not shown), such as a handheld remote-control device, or a computing device, including any stationary or mobile computing device, such as a smartphone, a tablet, or the like. The controller is communicatively and operatively coupled to the device 100, whether wired or by a wireless signal, such as Bluetooth, or an internet connection, to remotely cause changes in the operation of an element, or combination of elements, of device 100. Operation of elements caused to change in response to a signal from the controller, in some embodiments, may include the drive motor 120, offset member 106, offset adjustor 107, height adjustor 108, and rotary-to-linear motion device 130, for example. The remote control may operate to adjust one or more operational parameters of PROM device 100, in any number or combination, such as the height of second end 113, the rotational frequency of second end 113, or to cause offset adjustor 107 to change the radius of the circular path, for example, in response to user input to the remote control.

Figure 6:
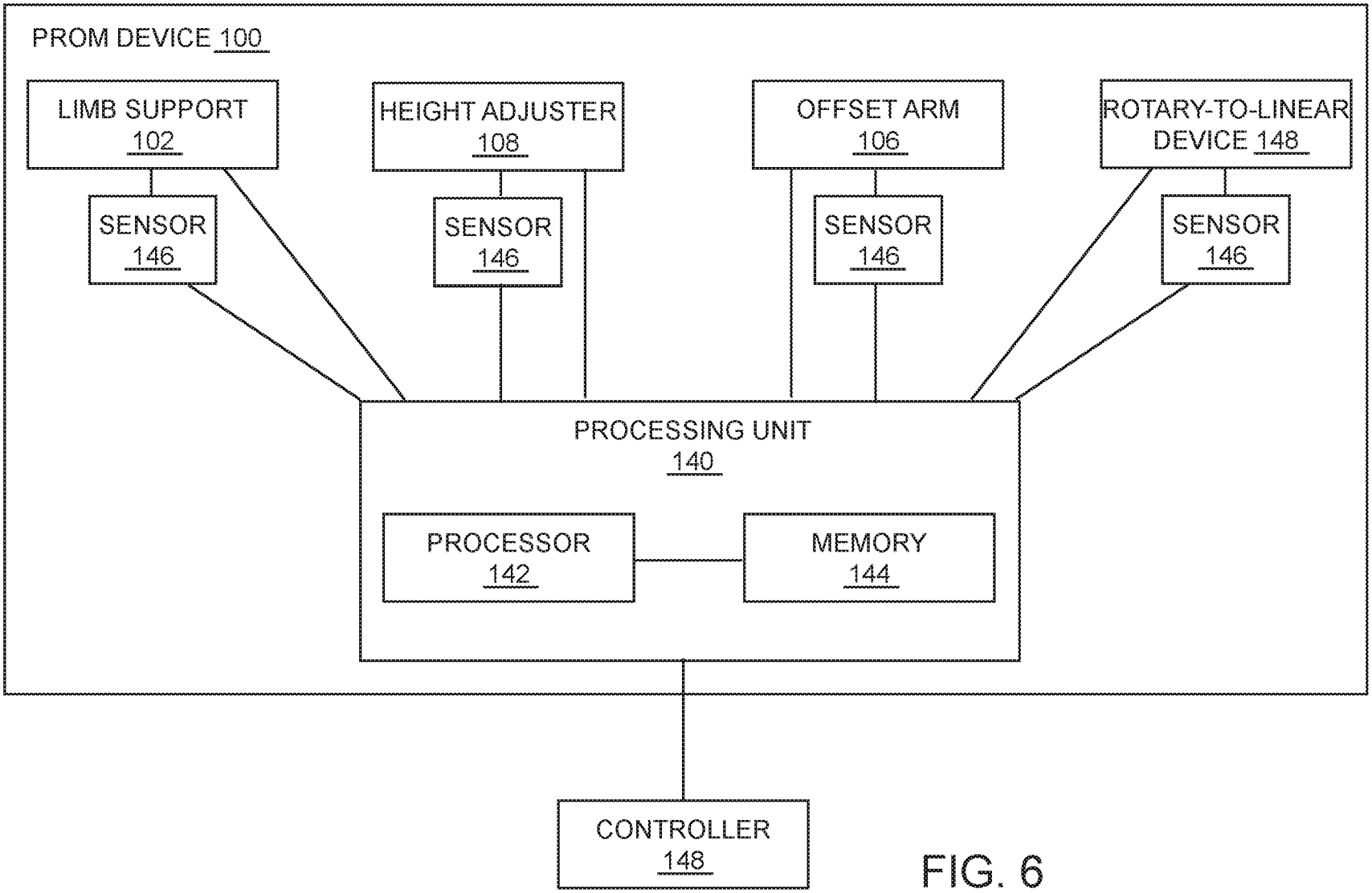
FIG. 6 is a block diagram of elements of a passive range of motion device, in accordance with an embodiment.

As shown in FIG. 6, some embodiments of device 100 may comprise one or more sensors 146 coupled to at least one controllable element of the device 100 for sensing position, orientation, motion, angle, speed, and/or frequency of motions, and the like, of various elements of device 100. For example, sensors 146 may be coupled to the height adjustor 108 for sensing the height at which it is adjusted, as well as the direction and speed at which it is being adjusted. Similarly, sensors 146 may be coupled to the drive motor and/or offset arm 106 for sensing the orientation angle, direction and speed of rotation, and length of the offset arm 106 and the direction and speed at which the length of the offset arm 106 is being adjusted. Likewise, sensors 146 may be coupled to other elements, such as the rotary-to-linear motion device 148 for sensing the orientation angle, direction and frequency of pendulation of the oscillating arm 134, or to the limb support 102 to sense the angle between the first section 122 and the base or the angle between the first section 122 and the second section 124. In addition, sensors 146 may be utilized to sense the angle of rotation of the pivoting member 103 with respect to the base 102. The descriptions of various sensors 146 and their uses, as described herein, is not intended to be limiting. It should be understood that any of a variety of sensors 146 may be utilized for sensing a status of a controllable element, including position, orientation, motion, angle, speed, and/or frequency of motions, and the like, of various controllable elements of device 100.

As shown in FIG. 6, some embodiments of device 100 may comprise a processing unit 140 coupled to the device 100 and communicatively coupled to the various sensors of device 100 and to the controller of the device 100, the processing unit 140 further comprising a processor 142 and a memory 144. The processor 142 may be programmed or pre-programmed to receive signals from the various sensors 146, the signals containing information about the various elements of the device 100, as described above. The processor 142 may process these signals and store and/or retrieve such information to or from the memory 144. The processor 142 may also send such information to the controller 148 for display on the controller 148. The processor 142 may further be communicatively coupled to the drive motors and/or actuators of the various elements of the device 100, such that the drive motors and/or actuators may be controlled by the processor 142. For example, such control may include activation, deactivation, speed and/or direction control. The processor 142 may be programmed or pre-programmed to control the various elements of the device 100 in response to input by a user to the controller 148.

In some embodiments, the processing unit 140 may be configured to store user information on the memory 144. For example, in operation, a user may create a user profile, including a user name, a password, and/or other user-identifying information. Without limitation, the processing unit 140 may be programmed to store, on the memory 144, one or more pieces of information regarding the status of the at least one controllable element of the device 100 while the device 100 is in use by a user, as that information is received by the processing unit 140 from a sensor 146 coupled to the at least one controllable element. The information may be stored on the memory 144 in association with the user profile of the user that was using the device 100 when the information was received by the processing unit 140. For example, when a user uses the device 100, information may be stored to the memory 144 regarding the maximum flexion/extension angle of the limb support 102, the angle of the plane of circular motion of the second end 113 of the limb support 102, the height of the second end 113 of the limb support 102, the amount of time the user used the device 100, the number of repetitions of any particular motion of the device 100, and the like. Such information may be stored to create a usage record for the user. The processing unit 140 may be programmed to retrieve the usage record, and/or any other information stored on the memory 144, for display on the controller 148 for a user to view. The user may then make adjustments to the status of the at least one controllable element by input to the controller 148. For example, without limitation, a user may use the device 100 at one location and a physical therapist overseeing treatment of the user may access the usage record of a user remotely and make adjustments to the device 100 to change the status of the at least one controllable element. For example, the physical therapist may remotely increase the length of the offset member 106 to increase the radius of a circular path during the user's next use of the device 100 in order to increase abduction/adduction and flexion/extension motion of the user's leg as part of a progressive treatment/therapy program for the user. In some embodiments, the physical therapist may monitor such information in real time while the user is using the device 100.

In some embodiments, user information and user records, including the status of at least one controllable element of the device 100 may be stored remotely on, and/or retrieved from, a controller 148, or a server that is communicatively coupled to and accessible by the controller 148.

Figure 7:
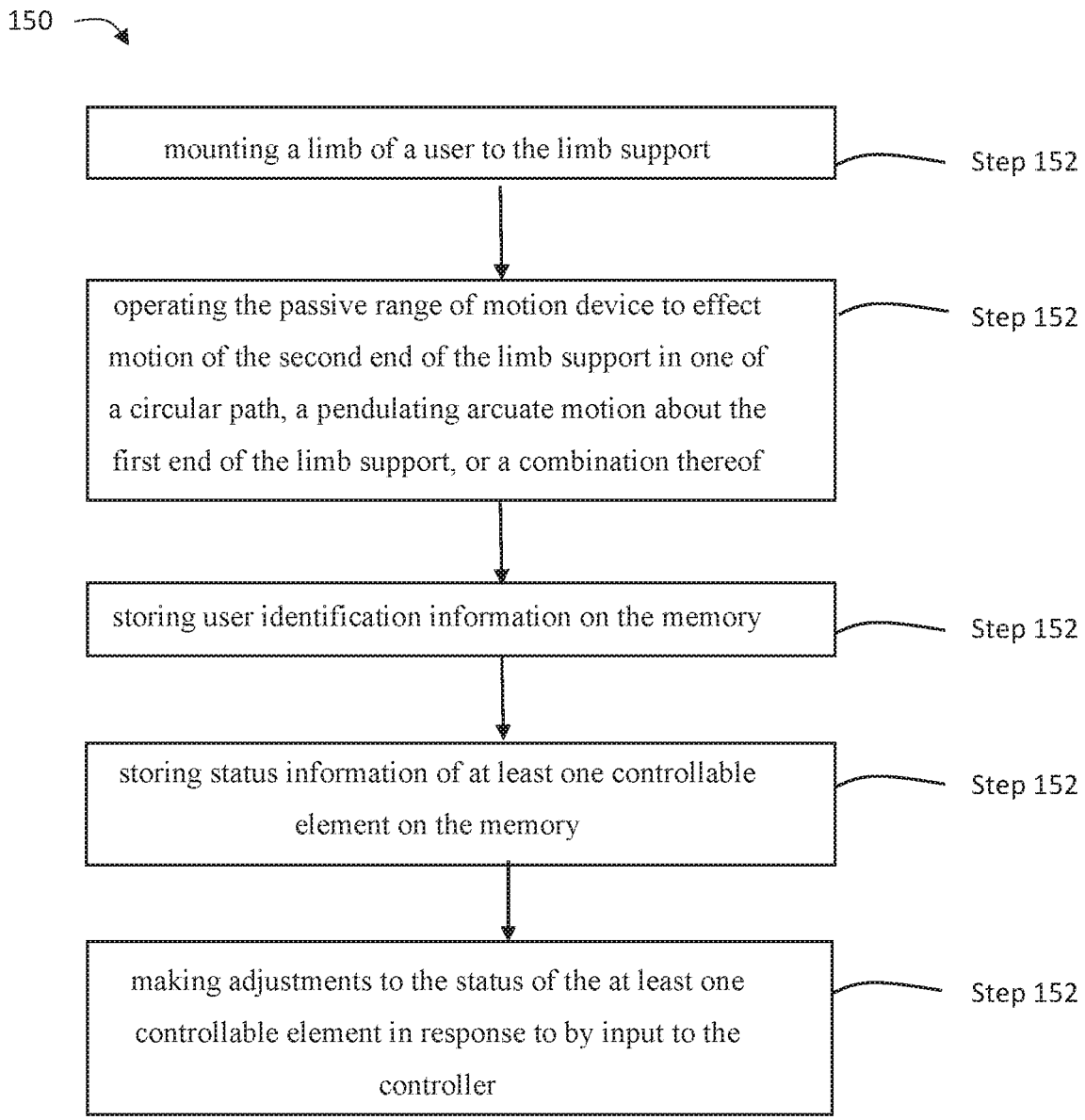
FIG. 7 is a flow-chart diagram of a method of use of a passive range of motion device, in accordance with an embodiment.

Embodiments of a method of use of a passive range of motion device may comprise: mounting a limb of a user to the limb support; and operating the passive range of motion device to effect motion of the second end of the limb support in one of a circular path, a pendulating arcuate motion about the first end of the limb support, or a combination thereof. Other embodiments of a method of use of a passive range of motion device, as shown in FIG. 7, may comprise the steps: mounting a limb of a user to the limb support [Step 152]; operating the passive range of motion device to effect motion of the second end of the limb support in one of a circular path, a pendulating arcuate motion about the first end of the limb support, or a combination thereof [Step 154]; storing user identification information on the memory [Step 156]; storing status information of at least one controllable element on the memory [Step 158]; and making adjustments to the status of the at least one controllable element in response to by input to the controller [Step 160].

The components defining any passive range of motion device 100 may be formed of any of many different types of materials or combinations thereof that can readily be formed into shaped objects provided that the components selected are consistent with the intended operation of the passive range of motion device 100. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any passive range of motion device 100 may be purchased pre-manufactured or manufactured separately and then assembled together. However, any of or all the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, annealing, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible considering the teachings herein without departing from the spirit and scope of the forthcoming claims.

What is claimed is:

1. A passive range of motion device comprising:

a base;

a limb support having a first end and a second end, the first end thereof being pivotally coupled to the base;

an offset member pivotally coupled to the second end, wherein the second end moves along a circular path in response to rotation of the offset member; and a first drive motor operationally coupled to the offset member, wherein the offset member rotates in response to operation of the first drive motor.

2. The passive range of motion device of claim 1, further comprising a height adjuster coupled between the offset member and the base for adjusting the height of the offset member relative to the base.

3. The passive range of motion device of claim 1, wherein the length of the offset member is adjustable, such that the radius of circular path is variable and corresponds to the length of the offset member.

4. The passive range of motion device of claim 2, wherein the limb support further comprises:

a first section incorporating the first end of the limb support; and a second section incorporating the second end of the limb support, the second section being hingedly coupled to the first section at a hinge joint disposed between the first end and the second end.

5. The passive range of motion device of claim 4, further comprising:

a slide mechanism operationally coupled between the height adjuster and the base; and an actuator coupled between the height adjuster and the base for moving the height adjuster along the slide mechanism, wherein the hinge joint is raised in response to the height adjuster moving along the slide mechanism toward the first end of the limb support and the hinge joint is lowered in response to the height adjuster moving along the slide mechanism away from the first end of the limb support.

6. The passive range of motion device of claim 1 further comprising:

a rotary-to-linear motion device operationally coupled between the offset member and the second end of the limb support, the rotary-to-linear motion device further comprising:

a second drive motor;

a mechanism coupled to the second drive motor for converting rotational motion of the second drive motor to linear motion; and an oscillating arm operationally coupled between the mechanism and the second end of the limb support, wherein the oscillating arm pendulates in response to rotation of the second drive motor, thereby causing the second end of the limb support to pendulate in an arcuate motion about the first end of the limb support.

7. The passive range of motion device of claim 6, wherein the rotary-to-linear motion device is adjustable, such that the magnitude of pendulation of the oscillating arm is adjustable in response to adjustment of the rotary-to-linear motion device.

8. The passive range of motion device of claim 7, wherein the plane of pendulation of the second end of the limb support is determined by the angle of rotation of the offset member with respect to the first drive motor, wherein the plane of pendulation may be any of a vertical plane, a horizontal plane, or a diagonal plane.

9. The passive range of motion device of claim 8, further comprising:

at least one sensor coupled to at least one controllable element of the passive range of motion device, wherein the at least one controllable element is one of the limb support, the offset member, the first drive motor, the second drive motor, the actuator, the height adjuster, the slide mechanism, the rotary-to-linear motion device, and the oscillating arm, wherein the at least one sensor is configured to sense a status of the at least one controllable element to which it is coupled;

a processing unit coupled to the passive range of motion device and communicatively coupled to the at least one sensor and to the at least one controllable element, the processing unit further comprising:

a processor; and a memory; and a controller communicatively coupled to the processing unit, wherein the processing unit is configured to receive status information from the at least one sensor regarding the at least one controllable element to which the at least one sensor is coupled and to control the at least one controllable element in response to user input to the controller.

10. A passive range of motion device comprising:

a base;

an offset member;

a limb support comprising:

a first end pivotally coupled to the base and a second end; and a rotary-to-linear motion device operationally coupled to the second end, the rotary-to-linear motion device further comprising:

a drive motor;

a mechanism coupled to the drive motor for converting rotational motion of the drive motor to linear motion; and an oscillating arm operationally coupled between the mechanism and the second end, wherein the oscillating arm pendulates in response to rotation of the drive motor, thereby causing the second end of the limb support to pendulate in an arcuate motion about the first end of the limb support.

11. The passive range of motion device of claim 10, wherein the orientation of the rotary-to-linear motion device is adjustable, such that the plane of pendulation of the second end of the limb support is determined by the orientation of the rotary-to-linear motion device, wherein the plane of pendulation may be any of a vertical plane, a horizontal plane, or a diagonal plane.

12. The passive range of motion device of claim 10, wherein the rotary-to-linear motion device is adjustable, such that the magnitude of pendulation of the oscillating arm is adjustable in response to adjustment of the rotary-to-linear motion device.

13. The passive range of motion device of claim 12, further comprising a height adjuster coupled between the rotary-to-linear motion device and the base for adjusting the height of the rotary-to-linear motion device relative to the base.

14. The passive range of motion device of claim 13, wherein the limb support further comprises:

a first section incorporating the first end of the limb support; and a second section incorporating the second end of the limb support, the second section being hingedly coupled to the first section at a hinge joint disposed between the first end and the second end.

15. The passive range of motion device of claim 14, further comprising:

a slide mechanism operationally coupled between the height adjuster and the base; and an actuator coupled between the height adjuster and the base for moving the height adjuster along the slide mechanism, wherein the hinge joint is raised in response to the height adjuster moving along the slide mechanism toward the first end of the limb support and the hinge joint is lowered in response to the height adjuster moving along the slide mechanism away from the first end of the limb support.

16. The passive range of motion device of claim 15, further comprising:

at least one sensor coupled to at least one controllable element of the passive range of motion device, wherein the at least one controllable element is one of the limb support, the offset member, the drive motor, the actuator, the height adjuster, the slide mechanism, the rotary-to-linear motion device, and the oscillating arm, wherein the at least one sensor is configured to sense a status of the at least one controllable element to which it is coupled;

a processing unit coupled to the passive range of motion device and communicatively coupled to the at least one sensor and to the at least one controllable element, the processing unit further comprising:

a processor; and a memory; and a controller communicatively coupled to the processing unit, wherein the processing unit is configured to receive status information from the at least one sensor regarding the at least one controllable element to which the at least one sensor is coupled and to control the at least one controllable element in response to user input to the controller.

* * * * *